US006494988B1

(12) United States Patent
Cedra et al.

(10) Patent No.: US 6,494,988 B1
(45) Date of Patent: Dec. 17, 2002

(54) PROCESS FOR IMPROVING THE SURFACE OF OFFSET PAPER

(75) Inventors: Ingolf Cedra, Heidenheim (DE); Frank Wegehaupt, Böhmenkirch (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/557,403

(22) Filed: Apr. 24, 2000

(30) Foreign Application Priority Data

May 7, 1999 (DE) ..... 199 21 592

(51) Int. Cl.[7] ..... D21H 19/00; D21H 23/50

(52) U.S. Cl. ..... 162/135; 162/137; 162/175; 427/424; 427/479; 427/482; 427/485

(58) Field of Search ..... 162/135, 137, 162/175; 427/475, 476, 479, 480, 482, 485

(56) References Cited

U.S. PATENT DOCUMENTS

| | | | | |
|---|---|---|---|---|
| 3,919,042 A | | 11/1975 | Spiller | 162/175 |
| 4,946,101 A | | 8/1990 | Winheim | 239/8 |
| 5,045,342 A | | 9/1991 | Boissevain et al. | 427/8 |
| 5,399,193 A | * | 3/1995 | Bergh et al. | 106/211 |
| 5,411,637 A | | 5/1995 | Glomb et al. | 162/135 |
| 5,433,826 A | | 7/1995 | Glomb et al. | 162/135 |
| 5,789,031 A | | 8/1998 | Hirabayashi et al. | 427/341 |
| 6,063,450 A | | 5/2000 | Bernert et al. | 427/475 |
| 6,274,001 B1 | * | 8/2001 | Mohan | 162/206 |
| 6,372,361 B1 | * | 4/2002 | Mackewicz et al. | 428/537.5 |

FOREIGN PATENT DOCUMENTS

| | | |
|---|---|---|
| DE | 1942348 | 3/1971 |
| DE | 3819761 | 12/1989 |
| DE | 19545182 | 10/1996 |
| DE | 19542191 | 5/1997 |
| DE | 19632673 | 2/1998 |
| EP | 0345670 | 12/1989 |
| EP | 0881330 | 12/1998 |
| FR | 1550033 | 12/1968 |

* cited by examiner

*Primary Examiner*—Dean T. Nguyen
(74) *Attorney, Agent, or Firm*—Greenblum & Bernstein, P.L.C.

(57) ABSTRACT

Application device for a paper machine, a paper machine, a nozzle dampener, and a process for improving the surface of offset paper. The application device includes a plurality of nozzles distributed across a machine width as at least one row of nozzles, such that the plurality of nozzles are oriented to spray a passing paper web. The at least one row of nozzles is adapted for an alternative selective throughput of water and binding agent. The paper machine includes the application device. The nozzle dampener includes a plurality of nozzles distributed across a machine width as at least one row of nozzles, such that the plurality of nozzles are oriented to spray a passing paper web. The at least one row of nozzles are adapted to improve paper properties of offset paper by applying a binding agent onto the passing paper web. The process includes supplying a binding agent to at least one nozzle located within at least one of a drying section of a paper machine and a calender of the paper machine, and applying the binding agent across a width of a moving paper web in the at least one of the drying section and the calender.

19 Claims, 2 Drawing Sheets

PROCESS FOR IMPROVING THE SURFACE OF OFFSET PAPER

CROSS-REFERENCE TO RELATED APPLICATIONS

The present application claims priority under 35 U.S.C. §119 of German Patent Application No. 199 21 592.8, filed on May 7, 1999, the disclosure of which is expressly incorporated by reference herein in its entirety.

BACKGROUND OF THE INVENTION

1. Field of the Invention

The present invention relates to an application device, e.g., a nozzle dampener, for a paper machine, having a plurality of nozzles distributed across the machine width for spraying a passing paper web. The present invention further relates to a paper machine for producing rotogravure and offset paper having at least one drying section and one calender. In addition, the present invention relates to the use of a nozzle dampener for improving the paper properties of offset paper. Finally, the present invention also relates to a process for improving the surface of paper for use as offset printing paper.

2. Discussion of Background Information

In order to be able to achieve optimal printing quality, different printing processes place different requirements on the quality and properties of the paper being produced. Thus, high-quality printing is produced using, e.g., the rotogravure process or the offset printing process.

In the case of the rotogravure process, the printing ink is applied to the paper by the ink first accumulating in the recesses of a printing plate so that it can then be applied to the paper that passes by when the printing plate unrolls.

In contrast to this, in the offset printing process, the print image is projected onto a surface (hydrophilic/hydrophobic), whereby the surface properties change according to the print image. Hydrophobic locations absorb the positive printing inks, while hydrophilic locations absorb water.

Due to the great difference in printing techniques, different requirements are also placed on the quality and the properties of the paper to be printed. Thus, for example, paper that is especially suited for rotogravure is enriched with a very high proportion of filler in order to be able to optimally adjust the surface properties in the calendering process. Furthermore, in the case of offset printing, it is also very essential for the paper being used to have a high surface strength, give off as little dust as possible, and have only a low tendency to tear in order to be able to achieve the desired high printing quality and good pressroom runnability.

Most paper machines that are suited especially for producing one or the other type of paper are manufactured and operated according to these requirements. However, problems arise when the attempt is made to equip the same paper machine in such a way that it is suited for producing both variations of paper, i.e., rotogravure paper and offset paper, without having to make great adjustments when changing the paper type.

It is known from the unexamined German Patent Application DE 196 32 673 A1 that, in order to produce high-quality printing paper for the offset printing process, an attempt is made to add an auxiliary agent to the mass to increase the strength in the z-direction of the paper (perpendicular to the surface of the paper) or the surface strength. The disadvantage of this measure is the rather low efficiency of adding auxiliary agents to the mass in paper production. This means that a disproportionately high quantity of auxiliary agent (binding agent) is needed in the mass to achieve a sufficient effect on the surface.

In addition, it is generally known that the surface of a finished paper web is coated off-line with the aid of suitable application units subsequent to its production process and that this produces the high surface quality that is suitable for offset printing.

The disadvantage of this known process is that high production and investment costs are required for the additional application units, possibly for a separate facility for off-line application, and these units drive up the production costs for this type of paper.

Furthermore, nozzle dampeners that are used to spray water on a finished paper web in order to give the paper web a desired moisture profile that is as uniform as possible are known in prior art. After this treatment, the paper web is usually fed through calenders, thereby achieving an especially smooth surface that is as uniform as possible. Reference is made to documents EP 0 345 670 B1 and DE 38 19 761 C2 with respect to the nozzle dampeners, the disclosures of which are explicitly incorporated by reference herein in their entireties. A calender or glazing roller is known from unexamined German Patent Application DE 195 42 191 A1, for example.

SUMMARY OF THE INVENTION

The present invention discloses one single paper machine which is equally suited for selectively producing either rotogravure paper (self-contained paper) or offset paper as desired without protracted adjustments being necessary.

According to the invention, the paper machine to selectively produce rotogravure and offset paper includes at least one drying section and a calender, and at least one nozzle dampener located in the area of the drying section. The at least one nozzle dampener can be substantially exclusively utilized to homogenize the moisture cross profile of the paper web when producing rotogravure paper, and can be substantially exclusively utilized to apply a binding agent, e.g., starch, when producing offset paper.

By using the nozzle dampener in the drying section of the paper machine to apply binding agent, the instant invention enables both rotogravure paper as well as high-quality offset printing paper to be produced on one and the same paper machine without special adjustments having to be made.

If the paper is supposed to be suitable for offset printing on both sides, at least one nozzle dampener can be provided on both sides of the paper web.

In positioning the nozzle dampener or even another applicator operating with nozzles, it can be advantageous to maintain a distance of approximately 10 to 200 mm, preferably approximately 20 to 150 mm, and most preferably approximately 20 to 100 mm between the nozzle exit points of the nozzle dampeners and the paper web in order to avoid an excess formation of mist.

According to the invention, an application device, e.g., a nozzle dampener, is provided for a paper machine with a plurality of nozzles distributed across the machine width to spray a passing paper web, in which at least one row of nozzles is provided for the throughput of water and/or binding agent solution.

As a result of this embodiment, it is possible to adjust to the special properties of the binding agent solution so that the nozzles can be adapted according to the different consistency, viscosity, and throughput volume.

In this connection, it can also be advantageous for at least one row of nozzles, through which the binding agent flows, to be provided with nozzle openings that create a closed binding agent film on the passing paper web.

It can also be favorable, as a function of the binding agent used, to provide at least one row of nozzles with openings that form a spray jet with a droplet size of approximately 20 to 250 $\mu$m, preferably approximately 50 to 70 $\mu$m.

Another advantageous embodiment of the application device according to the invention provides that, for at least one row of nozzles, through which the binding agent flows, a device can be provided which regulates or controls the longitudinal profile and/or the cross profile of the applied mass of binding agent across the width of the machine. Thus, it is possible either to make sure that there is an uniform application layer in the production process or even to regulate or control the cross profile of the layer thickness across the web.

However, there is also the alternative possibility of compensating for irregularities in the previous paper thickness over a specific length and/or a specific section of the paper web by adapting the layer thickness of the application of the binding agent and, in this way, achieving an overall uniform mass cross profile and/or mass longitudinal profile of the paper web.

The device to regulate or control the mass cross profile and/or the mass longitudinal profile of the applied binding can contain, for example, a plurality of valves influencing the throughput volume, with one nozzle or group of nozzles of the application device being allocated to each valve.

However, there is also the possibility of influencing the mass cross profile and/or the mass longitudinal profile of the applied binding agent in such a way that the concentration of the applied binding agent is regulated or controlled across the machine width according to requirements for a more or less intensive application of binding agent.

A control circuit can be provided to regulate the mass longitudinal profile of the applied binding agent, and includes at least one measuring device for the mass longitudinal coupled to the application device so that a control circuit coupled thereto can be generated.

If the mass cross profile of the applied binding agent is to be regulated, a measuring device can be provided for the mass cross profile, which can be composed of, e.g., a single measuring head which travels across the width of the machine. In the same way, a plurality of measuring heads can be used, which are stationary and measure only a specific section or which are movable only over a specific section in the machine cross and travel over this section.

The application devices are also advantageously designed in such a way that the nozzles are set up for an average binding agent solution throughput, which is set up for a surface application of approximately 0.05 to 5 g/m$^2$ oven dry of binding agent with a concentration of the binding agent solution of approximately 2 to 30% by weight, preferably approximately 5 to 20% by weight, most preferably approximately 10 to 15% by weight and a machine speed of approximately 8 m/s to 50 m/s, and preferably approximately 10 m/s to 35 m/s. In addition, the nozzles of the application device should be designed for an average binding agent solution throughput of approximately 0.03 l/min. to 5 l/min., preferably approximately 0.05 l/min. to 3 l/min., and most preferably approximately 0.06 l/min. to 1 l/min.

With regard to the controllability of the application device, it is advantageous for the nozzles of the nozzle dampener to be provided with a zone width (i.e., the distance from nozzle to nozzle in a row that is the width of the machine) of 10 to 100 mm, preferably approximately 20 to 70 mm, and preferably approximately 25 to 50 mm.

In addition, it is advantageous for an especially uniform application of the binding agent on the paper web if at least two rows are provided with preferably one row for the nozzles applying the binding agent.

According to the invention, nozzle dampeners, which are known per se, can be used to improve the paper properties of offset printing paper, and to apply binding agent to the passing web in the area of the drying section. It is especially favorable, of course, if the nozzle dampener possesses at least one of the previously cited characteristics of a nozzle dampener according to the invention.

In addition, a process to improve the surface of offset paper is proposed, which distinguishes itself by a binding agent being applied to the paper web in the process of being produced across the machine width in the area of a drying section of a paper machine.

In this connection, it is especially advantageous if the application of the binding agent can occur with the aid of a nozzle dampener, with it being especially favorable for the application of the binding agent if the application of the binding agent takes place via a spray jet with a droplet size of approximately 20 to 250 $\mu$m, and preferably approximately 50 to 70 $\mu$m. As an alternative or a combination, there is also the possibility of setting up the application of the binding agent, particularly the nozzles of the application device, so that the binding agent is applied as a closed film on the paper web.

Another advantageous embodiment of the process according to the invention provides for the longitudinal profile and/or the cross profile of the applied mass of binding agent to be regulated or controlled across the width of the machine. This regulation can be designed in such a way that the masses of the applied binding agent take place via a section-by-section change in the concentration of the applied binding agent solution. The advantage of this is that only slight changes occur in the quantity of the solvent proportion to be vaporized. However, there is also the possibility of simply regulating the quantity of the sprayed binding agent solution. This can take place on a section-by-section basis or across the entire machine width.

Advantageous values for the surface application of the binding agent lie in a range of an average surface load of paper of approximately 0.05 to 5 g/m$^2$ oven dry of binding agent, whereby a concentration of the binding agent solution of approximately 2 to 30% by weight, preferably approximately 5 to 20% by weight, and most preferably approximately 10 to 15% by weight, can be used advantageously.

In addition, favorable operating values are produced if the nozzles of the application device have an average throughput of approximately 0.03 l/min. to 5 l/min. of binding agent solution, preferably approximately 0.05 l/min. to 3l/min., and most preferably approximately 0.06 l/min. to 1 l/min.

As already mentioned above, both sides of the paper web, instead of one single side of the paper web, can be coated with the binding agent by at least one nozzle dampener.

For an optimal connection between the applied binding agent and the paper web, the paper web should have a dry content of greater than approximately 55% when the binding agent is applied, preferably greater than approximately 60%, and most preferably greater than approximately 80%.

It can also be advantageous if the moisture cross profile of the paper web is influenced in the desired direction. Corresponding regulation and control mechanisms are known from the published German Patent Application DE 38 19 761 C2, for example.

The present invention is directed to an application device for a paper machine. The application device includes a plurality of nozzles distributed across a machine width as at least one row of nozzles. The plurality of nozzles are oriented to spray a passing paper web. The at least one row of nozzles is adapted for an alternative selective throughput of water and binding agent.

According to a feature of the present invention, the at least one row of nozzles, through which the binding agent selectively flows, includes nozzle openings adapted to create a closed binding agent film on the passing paper web.

Further, the at least one row of nozzles, through which the binding agent selectively flows, can include nozzle openings adapted to form a spray jet with a droplet size of approximately 20 to 250 $\mu$m. Further, the droplet size can be approximately 50 to 70 $\mu$m.

In accordance with another feature of the instant invention, a regulation or control device may be coupled to the at least one row of nozzles, through which the binding agent flows, to regulate or control at least one of a longitudinal profile and a cross profile of an applied mass of binding agent across the width of the machine.

According to another feature of the invention, the device to regulate or control at least one of the mass cross profile and the mass longitudinal profile of the applied binding can include a plurality of valves adapted to adjust throughput. Each of the plurality of valves may be allocated to one of one nozzle and a group of nozzles. To regulate the mass longitudinal profile of the applied binding agent, the application device can further include a measuring device for measuring the mass longitudinal profile and a control circuit coupled thereto. To regulate the mass cross profile of the applied binding agent, the application device can further include a measuring device for the mass cross profile and a control circuit coupled thereto.

In accordance with still another feature of the present invention, the plurality of nozzles may be designed for an average binding agent solution throughput for a surface application of approximately 0.05 to 5 g/m$^2$ oven dry of binding agent with a concentration of the binding agent solution of approximately 2% to 30% by weight binding agent. Further, the concentration of the binding agent solution can be approximately 5% to 20% by weight binding agent. Still further, the concentration of the binding agent solution can be approximately 10% to 15% by weight binding agent. A machine speed can be approximately 8 m/s to 50 m/s. Preferably, the machine speed can be approximately 10 m/s to 35 m/s.

According to a further feature of the invention, the plurality of nozzles can be designed for an average binding agent solution throughput of approximately 0.03 l/min. to 5 l/min. Further, the average binding solution throughput can be approximately 0.05 l/min. to 3 l/min. Still further, the average binding solution throughput can be approximately 0.06 l/min. to 1 l/min.

Moreover, the plurality of nozzles have a zone width, which is a distance between nozzles in the width direction of the machine, of approximately 10 mm to 100 mm. The zone width can be approximately 20 mm to 70 mm. Further, the zone width may be approximately 25 mm to 50 mm.

In accordance with a still further feature of the instant invention, the at least one row of nozzles can include at least two rows of nozzles, and at least one of the at least two rows of nozzles can be adapted to apply the binding agent.

According to another feature of the present invention, the application device can be located in a drying section of the paper machine, in an area in which a dry content of the paper web is greater than approximately 55%. Further, the application device may be located in an area of the drying section in which the paper web dry content is approximately greater than 60%. Further still, the application device can be located in an area of the drying section in which the paper web dry content is approximately greater than 80%.

The application device may be arranged in a calender of the paper machine in an area in which a dry content of the paper web is greater than approximately 90%.

According to still another feature of the instant invention, the application device can be a nozzle dampener.

The present invention is directed to a paper machine for selectively producing rotogravure and offset paper. The paper machine includes at least one drying section, a calender, and at least one application device located in an area of at least one of the drying section and the calender. When producing rotogravure paper, the at least one application device is utilized to homogenize a moisture cross profile of the paper web, and, when producing offset paper, the at least one application device is utilized to apply a binding agent. According to a feature of the invention, the binding agent may be starch.

In accordance with another feature of the present invention, the at least one application device can include at least one application device provided on both sides of the paper web.

According to another feature of the instant invention, the at least one application device can be arranged at a distance of approximately 10 mm to 200 mm from the paper web. Further, the distance of the at least one application device from the paper web can be approximately 20 mm to 150 mm. Still further, wherein the distance of the at least one application device from the paper web can be approximately 20 mm to 100 mm.

In accordance with a further feature of the present invention, the at least one application device can be a nozzle dampener that includes a plurality of nozzles distributed across a machine width as at least one row of nozzles, such that the plurality of nozzles are oriented to spray a passing paper web. The at least one row of nozzles can be adapted for an alternative selective throughput of water and binding agent.

The instant invention is directed to a nozzle dampener that includes a plurality of nozzles distributed across a machine width as at least one row of nozzles, such that the plurality of nozzles are oriented to spray a passing paper web. The at least one row of nozzles are adapted to improve paper properties of offset paper by applying a binding agent onto the passing paper web.

According to a feature of the invention, the at least one row of nozzles can be adapted to selectively improve paper properties of gravure paper by applying water onto the passing paper web.

The present invention is directed to a process for improving the surface of offset paper. The process includes supplying a binding agent to at least one nozzle located within at least one of a drying section of a paper machine and a calender of the paper machine, and applying the binding agent across a width of a moving paper web in the at least one of the drying section and the calender.

In accordance with a feature of the instant invention, the at least one nozzle can include a nozzle dampener.

According to another feature of the invention, the applying of the binding agent can include spraying at least one spray jet having a droplet size of approximately 20 to 250 μm. Further, the droplet size can be approximately 50 to 70 μm.

The process can also include one of regulating and controlling at least one of a longitudinal profile and a cross profile of an applied mass of the binding agent across the width of the machine. The one of regulating and controlling can include a section-by-section change in a concentration of an applied binding agent solution.

In accordance with a further feature of the present invention, a surface application of the binding agent can take place with an average surface load of paper of approximately 0.05 to 5 g/m$^2$ oven dry of binding agent with a concentration of a binding agent solution of approximately 2% to 30% by weight binding agent. Further, the concentration of the binding agent solution can be approximately 5% to 20% by weight binding agent. Still further, the concentration of the binding agent solution can be approximately 10% to 15% by weight binding agent.

Moreover, the at least one nozzle can have an average throughput of approximately 0.03 l/min. to 5 l/min. of binding agent solution. Further, the average throughput may be approximately 0.05 l/min. to 3 l/min. of binding agent solution. Still further, the average throughput may be approximately 0.06 l/min. to 1 l/min. of binding agent solution.

In accordance with a still further feature of the present invention, the moving paper web can be coated with the binding agent on both sides by at least one application device.

According to still another feature of the invention, the binding agent can be applied in the drying section to a paper web having a dry content greater than approximately 55%. Further, the binding agent can be applied to a paper web having a dry content greater than approximately 60%. Still further, the binding agent may be applied to a paper web having a dry content greater than approximately 80%.

In accordance with another feature of the invention, the binding agent can be applied in the calender to a paper web having a dry content greater than approximately 90%.

According to yet another feature of the present invention, the applying of the binding agent may influence a moisture cross profile of the paper web.

It is understood that the characteristics of the invention mentioned above and to be explained below can be used not only in the combinations indicated, but also in other combinations or alone without departing from the scope of the invention.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
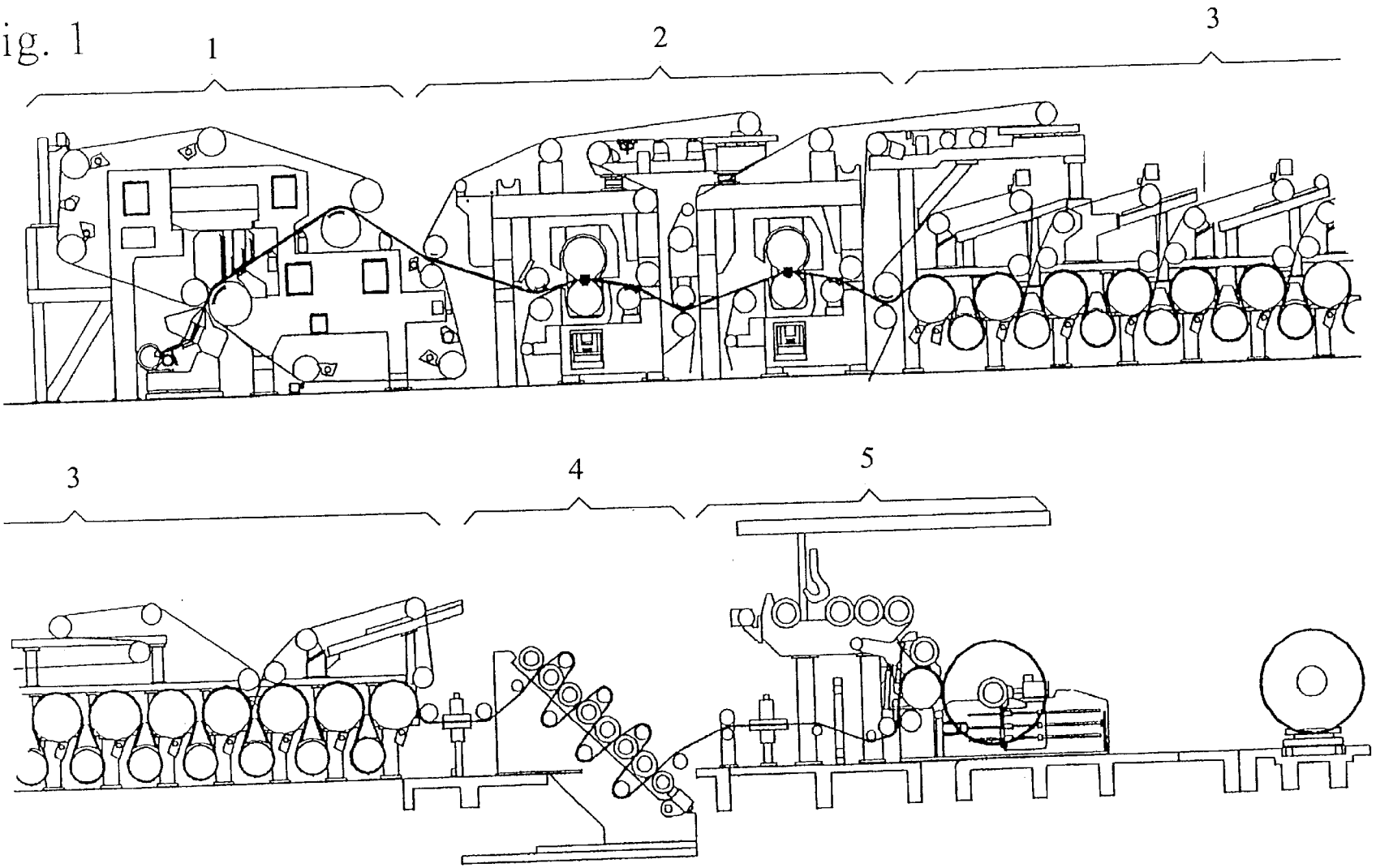
FIG. 1 illustrates a general overview of a paper machine.

FIG. 1 illustrates a general overview of a paper machine according to the invention with a sheet formation unit 1, which is embodied here as a twin-wire former. This is followed by a press section 2 having two press shoes, which is attached to a drying section 3, where the nozzle dampeners according to the invention are located, but not shown here. This is followed by the calender 4, which can also be provided with nozzle dampeners, and the winding section 5 in which the finished paper web is wound up.

Figure 2:
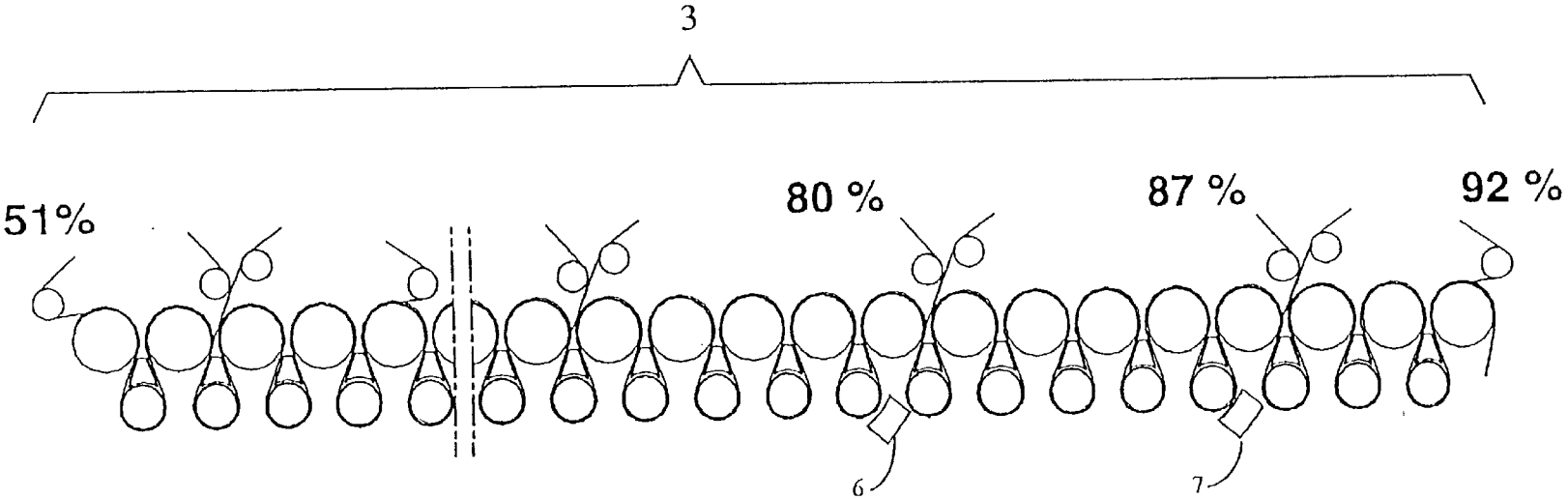
FIG. 2 illustrates a drying section of a paper machine in accordance with the instant invention with nozzle dampeners.

The drying section 3 is shown again in greater detail in FIG. 2. Shown here is a single-row drying section equipped with two nozzle dampeners 6 and 7 in a manner that is known per se, which are arranged only on one side of the paper web in this illustration.

The percentage figures above the illustrated drying section represent the substantial dry content of the paper passing through the drying section at each position. The possibility exists according to the invention of using these nozzle dampeners, which are known per se, to apply a binding agent, e.g., starch. Moreover, additional nozzle dampeners can be attached, which also provide the second side of the paper web to be dried with binding agent.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

1 Sheet formation unit
2 Press section
3 Drying section
4 Calender
5 Winding section
6, 7 Nozzle dampeners

What is claimed:

1. A process for improving the surface of offset paper, comprising:

supplying a binding agent to at least one nozzle located within at least one of a drying section of a paper machine and a calender of the paper machine; and applying the binding agent across a width of a moving paper web in the at least one of the drying section and the calender to improve paper properties of offset paper, wherein the binding agent is in a binding agent solution having a concentration of approximately 2% to 30% by weight binding agent.

2. The process according to claim 1, wherein the at least one nozzle comprises a nozzle dampener.

3. The process according to claim 1, wherein the applying of the binding agent comprises spraying at least one spray jet having a droplet size of approximately 20 to 250 $\mu$m.

4. The process according to claim 3, wherein the droplet size is approximately 50 to 70 $\mu$m.

5. The process according to claim 1, further comprising one of regulating and controlling at least one of a longitudinal profile and a cross profile of an applied mass of the binding agent across the width of the machine.

6. The process according to claim 5, wherein the one of regulating and controlling includes a section-by-section change in the concentration of the applied binding agent solution.

7. The process according to claim 1, wherein a surface application of the binding agent takes place with an average surface load of paper of approximately 0.05 to 5 g/m$^2$ oven dry of binding agent.

8. The process according to claim 7, wherein the concentration of the binding agent solution is approximately 5% to 20% by weight binding agent.

9. The process according to claim 7, wherein the concentration of the binding agent solution is approximately 10% to 15% by weight binding agent.

10. The process according to claim 1, wherein the at least one nozzle has an average throughput of approximately 0.03 l/min. to 5 l/min. of binding agent solution.

11. The process according to claim 10, wherein the average throughput is approximately 0.05 l/min. to 3 l/min. of binding agent solution.

12. The process according to claim 10, wherein the average throughput is approximately 0.06 l/min. to 1 l/min. of binding agent solution.

13. The process according to claim 1, wherein the moving paper web is coated with the binding agent on both sides by at least one application device.

14. The process according to claim 1, wherein the binding agent is applied in the drying section to a paper web having a dry content greater than approximately 55%.

15. The process according to claim 14, herein the binding agent is applied to a paper web having a dry content greater than approximately 60%.

16. The process according to claim 14, wherein the binding agent is applied to a paper web having a dry content greater than approximately 80%.

17. The process according to claim 1, wherein the binding agent is applied in the calender to a paper web having a dry content greater than approximately 90%.

18. The process according to claim 1, wherein the applying of the binding agent influences a moisture cross profile of the paper web.

19. The process according to claim 1, wherein, where the binding agent is applied to the web, the web is supported by at least one of a belt, a roll, and a wire.

* * * * *